United States Patent [19]

Davis

[11] Patent Number: 4,904,501

[45] Date of Patent: Feb. 27, 1990

[54] METHOD FOR CHROMIZING OF BOILER COMPONENTS

[75] Inventor: Thomas L. Davis, Louisville, Ohio

[73] Assignee: The Babcock & Wilcox Company, New Orleans, La.

[21] Appl. No.: 56,503

[22] Filed: May 29, 1987

[51] Int. Cl.[4] ..... C23C 16/00

[52] U.S. Cl. ..... 427/253

[58] Field of Search ..... 427/253

[56] References Cited

U.S. PATENT DOCUMENTS

| | | | |
|---|---|---|---|
| 2,855,332 | 10/1958 | Samuel | 427/253 |
| 3,775,151 | 11/1973 | Baker | 427/253 |
| 4,004,047 | 1/1977 | Grisik | 427/253 |
| 4,126,488 | 11/1978 | Kunst | 427/253 |

*Primary Examiner*—Sam Silverberg

*Attorney, Agent, or Firm*—Vytas R. Matas; Robert J. Edwards; Daniel S. Kalka

[57] ABSTRACT

An improved method of chromizing the surface of a ferritic boiler component. An aqueous coating composition is applied to the surface to be chromized, which includes at least 10% by weight of chromium, at least 12% by weight alumina, a binder of ammonium alginate or methyl cellulose, and a halide activator, and in which the weight ratio of chromium to water is greater than 0.7. Alternative embodiments involve the application of a halide activator over the top of a previously applied and dried coating that is lacking said halide activator, as well as to the application of multiple layer single component slurry coatings.

11 Claims, No Drawings

METHOD FOR CHROMIZING OF BOILER COMPONENTS

BACKGROUND OF THE INVENTION (1) Field of the Invention

This invention relates to an improved method for chromizing surfaces of ferritic boiler components and, more particularly, the interior surfaces of iron or steel boiler tubes, pipes and like components to prevent high temperature exfoliation.

(2) Description of the Related Art

The use of chromium in the production of iron and steel is well known in the art. An excellent text on the production and uses of chromium is presented in *CHROMIUM*, by A. H. Sully, Academic Press Inc., New York, 1954. Chapter 6-"Chromizing", pages 190–222, is particularly directed to the chromizing process.

Chromizing is a thermally activated diffusion process used to produce a high chromium content surface layer on an iron or steel surface. This process is typically used on boiler tubes, pipes, and other boiler components to provide an internal surface which is resistant to exfoliation, i.e., high temperature oxidation of the internal surface with subsequent breaking away or loss of the oxide layer. Boiler components are presently chromized by a process known as pack cementation, a technique that has been widely used throughout industry for many years. An excellent description of the exfoliation problem as it relates to power boilers, the consequences if left unchecked, and the use of the pack cementation chromizing process as a solution thereto is found in an American Society of Mechanical Engineers (ASME) publication 78-JPGC-Pwr-7, titled "Chromizing and Turbine Solid Particle Erosion", A. J. Blazewicz, et al, presented at the joint ASME/IEEE/ASCE Power Generation Conference in Dallas, Tex., U.S.A., on Sept. 10–14, 1978.

The pack cementation process involves placing a chromium containing pack mixture into close contact with the internal surface of the component to be chromized and subsequently heating the entire assembly to an elevated temperature for a specified period of time. In the pack cementation process, a pack mixture comprising chromium, an inert filler (e.g., alumina) and a halide activator (e.g., ammonium chloride) are blended together. To chromize the internal surface of a ferritic boiler component (e.g., tubing or pipe), the tubing or pipe is filled with the pack mixture. The component is then loaded into a controlled atmosphere retort (i.e., reaction vessel) or made into a self-contained retort by the welding of caps onto the ends of the component. The entire assembly is then heated to an elevated temperature and held for a specified length of time to allow the desired chemical reactions and subsequent thermal diffusion process to occur. A typical pack cementation thermal cycle involves holding the entire assembly from one to ten hours in the temperature range from 1800° to 2200° F. A high chromium content surface layer is formed on the internal surface of the component which was in contact with the pack mixture by diffusion of the chromium into the iron. At the end of the thermal cycle, the entire assembly is cooled to room temperature, and the welded end caps removed if necessary, so that the used pack mixture can be removed from the interior. The component is then subjected to a post process cleaning step. The end result of this process is a relatively thick (equal to or greater than 0.002 inches, i.e., 2 mils) chromium diffusion coating on the internal surface of the tubular boiler component.

This diffusion coating nominally consists of a thin outer zone of chromium carbide, with an underlying zone of columnar ferrite characterized by a decreasing chromium concentration with increasing depth of diffusion. Typical "target" (and normally produced) chromized thickness layers are approximately 2 mils (0.002 inches) thick for Croloy 2-$\frac{1}{4}$ tubing, and approximately 6 mils (0.006 inches) thick for Croloy 2-$\frac{1}{4}$ pipe. In the tubing, the 2 mil thick chromium rich zone would contain an outer chromium carbide layer about $\frac{1}{8}$ mil (0.000125 inches) thick with the underlying columnar ferrite layer comprising the balance of the layer. A similar but somewhat thicker layer was normally observed when chromizing the pipe material, even when using the same general processing conditions, resulting in the 6 mil thick chromium rich zone having an even thinner (i.e., $<1/16$ mil or 0.0000625 inches thick) outer carbide layer. This difference in chromizing depths and structure is attributable at least in part to the lower carbon content in the surface of the piping than in the tubing that occurs due to the different processes involved in their manufacture.

Baldi (U.S. Pat. Nos. 4,208,453 and 4,209,391) describes various aspects of the above-described pack cementation process for the diffusion coating of steam boiler tubes. Aluminized or chromized coatings can be obtained by the pack cementation processes described therein.

Ramirez (U.S. Pat. No. 3,475,161) describes a method for the formation of cemented carbide surface coatings on metal products, and involves the preparation of a dip coating bath containing an organic solvent, organic binder, and metal or metal/ceramic powder. The method applies a metal or ceramic coating to the surface of a part, and sinters the coating (at 2200° to 2600° F. thermal cycle) for adherence; thus the applied coating itself becomes the surface desired.

The pack cementation technique, while proven to be an effective method for chromizing the internal surfaces of boiler components, has several inherent disadvantages. For example, the pack mix preparation, loading, and removal steps are tedious and time consuming. The gravity loading techniques which are typically employed for filling elongated tubular components require shop areas with high ceilings, or floor pits, or both, to accommodate components as long as 30 feet in length. Moreover, diffusion thermal cycles are relatively long due to the poor thermal conductivity of the pack mix. Finally, large quantities of pack mix can be required since the internal cavity of the component to be chromized must be filled.

Other developments in chromizing have addressed the chromizing of sheet metal or strip through processes that are, in essence, variants of the pack cementation process described above. Seelig (U.S. Pat. No. 3,257,227) describes a method for producing a diffusion coating on metals which uses a powdered composition or mixture as the source of the treating materials, and which is particularly suited to the treatment of metals in the form of long sheets or rolls. In the method, a dry pack mixture is fed into the gap area between sheets during the step of rolling the sheets into a coil, and the coil is subsequently heated to effect the diffusion process. Forand, Jr., et al (U.S. Pat. No. 3,728,149) discloses a method of forming a corrosion resistant coating on steel strip. The method involves applying a chromium-containing powder, such as ferrochrome, to at least one side of the surface of the steel strip or sheet which has, preferably, been coated previously with a volatile liquid having sufficient tackiness characteristics to act as a temporary bonding agent for the powder. A minor proportion of an alkali metal or alkaline earth metal halide is added to the metal powder. The powder coated strip is subjected to a roll compacting operation, or an equivalent means of densification, to develop a more adherent bond between the powder and the strip and is then heated for a time and at a temperature sufficient to produce an adherent iron-chromium alloy on the surface of the strip.

Hauel, et al (U.S. Pat. No. 3,434,871) discloses a method for the preparation of chromium-containing films suitable as resistor coatings on refractories, as conductive thin films, and as corrosion-resistant, thermally stable and oxidation-resistant films. The films are produced by thermal decomposition of a chromium-halide-amine complex; the chromium halide is coated with an organic amine, and if indicated by viscosity requirements, in the presence of an organic solvent such as toluene, chloroform and the like in which the amine complex is soluble. The deposited layer again become the "coating" for the product of interest.

Baker, et al (U.S. Pat. No. 3,775,151) discloses a method for the preparation of chromized ferrous metal sheet material in a high-speed commercial coating line. A non-compacted adherent coating containing a chromium energizer and a particulate source of metallic chromium are applied to the metal sheet. A uniform film or coating of a volatiliizable liquid having a halogen-containing energizer and/or binder therein is applied on at least one surface of the clean dry sheet material, and the resulting wet sheet material is passed through a powder deposition zone where a particulate coating of powdered metallic chromium-containing material is applied thereon. These thin films become an integral part of the component being coated, and are not removed subsequent to processing as is the pack mix in the pack cementation process. As such, this process is more closely allied with vapor plating techniques.

The above methods adapted to the task of chromizing sheet metal or strip involving rolling and/or pressing operations are not suited to the solution of the problems discussed above with respect to the chromizing of ferritic boiler components such as tubes, piping, headers and the like. Therefore, a need exists for an improved method of chromizing a surface of a ferritic boiler component which will overcome these disadvantages in an economical fashion and yet still produce chromized surfaces of acceptable quality and thickness.

SUMMARY OF THE INVENTION

The present invention provides an alternative to the conventional pack cementation method for chromizing the internal surface of a ferritic boiler component. An aqueous coating composition comprised of chromium, a filler (preferably alumina), water, a binder and a halide activator is prepared, and may take the form of a slurry or paste. The aqueous coating composition is applied only to the surface of the ferritic boiler component to be chromized, and is particularly suited for chromizing the interior surfaces of tubing, pipe or hollow forgings. Since the aqueous coating composition needs to be applied only to the surface of the component to be chromized, rather than by filling the entire component as is typically done in the pack cementation process, the amount of aqueous coating composition required is significantly less than the amount of pack mix required to chromize the same surface area in the pack cementation process. Reductions of up to ninety-five percent in the amount of chromizing materials employed can be achieved, thereby reducing initial storage and post processing costs, while also allowing faster application of the material and shorter process thermal cycle times.

In a first embodiment of the inventive technique, the chromium, filler and the halide activator are added to the vehicle (a premixed solution of the water and binder) to create an aqueous coating composition slurry mix in the form of relatively viscous fluid suspension. After preparation, the slurry mix is applied directly in a thin layer to a precleaned surface of the ferritic boiler component to be chromized. Slurry mix application is performed by an appropriate conventional method such as dipping, brushing or spray coating. After slurry mix application, the coated ferritic boiler component is heated to a low temperature and held for a desired amount of time to dry the coating and thereby provide adequate bonding strength for subsequent handling operations. The coated ferritic boiler component is then prepared for the chromizing thermal cycle. If the size of the ferritic boiler component permits, it is placed inside a retort. On the other hand, if the ferritic boiler component is, say, a large piece or hollow forging, it is made into a self-contained retort by sealing the ends with end caps which can be attached thereto by welding or other suitable means. This self-contained retort, however, is generally provided with an exhaust to permit products of the thermally activated diffusion process, (e.g. water vapor and iron bromide) to be released and to prevent pressure build-up. Argon gas flow into the self-contained retort can also be provided (as is done in the conventional pack cementation chromizing process) if necessary to prevent infiltration of air into the retort. It is not necessary, however, to provide such in the practice of the present invention. After the chromizing thermal cycle is complete, the end caps are removed (if required), the used slurry mix is unloaded, and the chromized ferritic boiler component is subjected to post process cleaning essentially by the same procedure used with the standard pack cementation technique.

In accordance with a second embodiment of the inventive technique, the halide activator is initially omitted from the aqueous coating composition slurry mix. The slurry mix (minus the halide activator) is applied to the surface of the ferritic boiler component and then dried. At that point, the halide activator is then applied over the dried slurry mix composition. The subsequent application of the halide activator permits precoating of the components to be treated without timing and atmospheric storage controls.

In accordance with a third embodiment of the inventive technique, multiple layer slurry coatings with single element compositions for each layer are applied to the surface of the ferritic boiler component to be chromized. The difference between this embodiment and the previously discussed embodiments is that only alumina or chromium is the solid component in each layer. In general, the first layer (undercoating) applied to the ferritic boiler component surface is comprised of alumina and binder; the second layer (top coat) is comprised of chromium and binder and is applied in a sufficient thickness to provide essentially the same calculated chromium potential as that provided by a much thicker multiple component, single layer slurry.

Accordingly, one aspect of the present invention is to provide a method of chromizing a surface of a ferritic boiler component which involves applying an aqueous coating composition to the surface, the aqueous coating composition containing at least 10% by weight of chromium, at least 12% by weight alumina, a binder selected from the group of ammonium alginate or methyl cellulose, and a halide activator, and where the weight ratio of chromium to vehicle in the aqueous coating composition is greater than 0.7.

Another aspect of the present invention is to provide a method of chromizing a surface of a ferritic boiler component wherein the halide activator is initially omitted from the aqueous coating composition slurry mix applied to the surface but which is later applied over the dried slurry mix composition.

Yet another aspect of the present invention is to provide a method of chromizing an internal surface of a tubular ferritic boiler component through the application of an aqueous coating composition slurry mix, having the aforementioned composition.

Yet still another aspect of the present invention is to provide a method of chromizing a surface of a ferritic boiler component through means of a multiple layer slurry coatings with single element compositions for each layer which are applied to the surface to be chromized.

The various features of novelty which characterize the invention are pointed out with particularity in the claims annexed to and forming a part of this disclosure. For a better understanding of the present invention, its operating advantages and specific results attained by its uses, reference is made to the accompanying descriptive matter in which the preferred embodiments of the present invention are illustrated.

DETAILED DESCRIPTION

In carrying out the novel process of the invention, a coating composition is introduced onto the surface of the boiler component which is to be chromized by spray coating, dipping, brushing, spread coating, or flow coating. The coating composition may be applied in the form of aqueous solutions, suspensions, dispersions, and the like.

The following examples are illustrative and explanatory of the invention. All percentages are expressed as weight percentages, as-applied, prior to application and subsequent drying, unless otherwise indicated.

EXAMPLE I

The aqueous coating compositions used in this example were each prepared by adding a binder, such as ammonium alginate (SUPERLOID, made by Kelco Co.) or methyl cellulose (METHOCEL A4C, made by Dow Chemical) to water, and mixing the solution together to form the vehicle. Chromium (−100 mesh electrolytic chromium), alumina (−100 mesh Alcoa tabular alumina-T61) and the halide activator (ammonium chloride) in powdered form are then blended into the vehicle solution to form the relatively viscous aqueous slurries of Table 1. The slurries were applied to coupons and ring sections of Croloy 2-¼ tubing (ASTM A213 T-22) by brushing, pouring, or spraying as indicated in Table 2. Spray coatings were applied using a standard spray gun (DeVilbiss Model JGA-5024) designed for use with thick solutions. The aqueous coating compositions were then subjected to the process thermal cycle conditions of time and temperature shown in Table 2.

TABLE 1

| Trial No. | Slurry Specimen | Chromium (%) | Alumina (%) | Ammonium Chloride (%) | Binder* Type | Binder* (%) | Water (%) |
|---|---|---|---|---|---|---|---|
| 1 | 1 | 12.5 | 50.0 | 12.5 | A | 0.49 | 24.51 |
| | 2 | 10.0 | 40.0 | 10.0 | A | 0.78 | 39.22 |
| | 3 | 12.5 | 50.0 | 12.5 | A | 0.49 | 24.51 |
| | 4 | 10.0 | 40.0 | 10.0 | A | 0.78 | 39.22 |
| | 5 | 12.5 | 50.0 | 12.5 | A | 0.49 | 24.51 |
| 2 | 1 | 12.5 | 50.0 | 12.5 | A | 0.49 | 24.51 |
| | 2 | 10.0 | 40.0 | 10.0 | A | 0.78 | 39.22 |
| | 3 | 10.0 | 40.0 | 10.0 | A | 0.78 | 39.22 |
| 3 | 1 | 8.25 | 33.0 | 8.25 | B | 1.00 | 49.50 |
| | 2 | 8.25 | 33.0 | 8.25 | B | 1.00 | 49.50 |
| 4 | 1 | 8.25 | 33.0 | 8.25 | B | 1.00 | 49.50 |
| | 2 | 8.25 | 33.0 | 8.25 | B | 1.00 | 49.50 |
| 5 | 1 | 14.65 | 30.70 | 7.67 | B | 0.93 | 46.05 |
| | 2 | 14.65 | 30.70 | 7.67 | B | 0.93 | 46.05 |
| 6 | 1 | 13.51 | 54.05 | 13.51 | A | 0.56 | 18.37 |
| | 2 | 13.75 | 28.81 | 13.35 | A | 0.87 | 43.22 |
| 7 | 1 | 13.51 | 54.05 | 13.51 | A | 0.56 | 18.37 |
| | 2 | 13.51 | 54.05 | 13.35 | A | 0.56 | 18.37 |
| 8 | 1 | 13.75 | 28.81 | 13.35 | B | 0.87 | 43.22 |
| | 2 | 13.75 | 28.81 | 13.35 | B | 0.87 | 43.22 |
| 9 | 1 | 13.75 | 28.81 | 13.50 | B | 0.87 | 43.22 |

*Binder Type
A: Ammonium Alginate
B: Methyl Cellulose

TABLE 2

| Trial No. | Slurry Specimen | Application Method | Chromizing Cycle Temp. (°F.) | Chromizing Cycle Time (hrs) | Chrome/Water Ratio | Activator/Water Ratio | Applied Slurry Thickness (mils) | Calculated Chrome Potential (gm/in$^2$) |
|---|---|---|---|---|---|---|---|---|
| 1 | 1 | Brush | 2000 | 1 | 0.51 | 0.51 | 7 | 0.33 |
| | 2 | Brush | 2000 | 1 | 0.25 | 0.25 | 4 | 0.30 |
| | 3 | Brush | 2000 | 1 | 0.51 | 0.51 | 24 | 0.33 |
| | 4 | Brush | 2000 | 1 | 0.25 | 0.25 | 1 | 0.07 |
| | 5 | Pour | 2000 | 1 | 0.51 | 0.51 | 70 | 0.26 |
| 2 | 1 | Brush | 2000 | 1 | 0.51 | 0.51 | 48 | 0.12 |
| | 2 | Brush | 2000 | 1 | 0.25 | 0.25 | 33 | 0.13 |
| | 3 | Pour | 2000 | 1 | 0.25 | 0.25 | 36 | 0.18 |
| 3 | 1 | Spray | 2000 | 1 | 0.17 | 0.17 | 5 | 0.01 |
| | 2 | Spray | 2000 | 1 | 0.17 | 0.17 | 17 | 0.04 |
| 4 | 1 | Pour | 2100 | 2 | 0.17 | 0.17 | 125 | 0.11 |
| | 2 | Pour | 2100 | 2 | 0.17 | 0.17 | 125 | 0.11 |
| 5 | 1 | Spray | 2000 | 1 | 0.32 | 0.17 | 36 | 0.16 |
| | 2 | Brush | 2000 | 1 | 0.32 | 0.17 | 125 | 0.56 |
| 6 | 1 | Brush | 2000 | 1 | 0.73 | 0.73 | 125 | 0.51 |
| | 2 | Brush | 2000 | 1 | 0.32 | 0.31 | 125 | 0.52 |
| 7 | 1 | Pour | 2000 | 1 | 0.73 | 0.73 | 125 | 0.51 |
| | 2 | Pour | 2000 | 1 | 0.73 | 0.73 | 125 | 0.51 |

TABLE 2-continued

| Trial No. | Slurry Specimen | Application Method | Chromizing Cycle Temp. (°F.) | Chromizing Cycle Time (hrs) | Chrome/ Water Ratio | Activator/ Water Ratio | Applied Slurry Thickness (mils) | Calculated Chrome Potential (gm/in$^2$) |
|---|---|---|---|---|---|---|---|---|
| 8 | 1 | Pour | 2000 | 3 | 0.32 | 0.31 | 125 | 0.52 |
| | 2 | Pour | 2000 | 3 | 0.32 | 0.31 | 125 | 0.52 |
| 9 | 1 | Pour | 1900 | 3 | 0.32 | 0.31 | 125 | 0.52 |

Three factors are noted. First, although chromium content remains constant for a given slurry, use of a thinner applied slurry can significantly reduce the chromium potential (i.e., grams of Cr/in$^2$ of surface area) of the mix. Second, it was found that use of reduced chromium content in a slurry, with or without reducing the applied thickness of the slurry, also reduces chromium potential. Finally, the use of higher water content appeared to cause significant surface rusting on the samples. Since this rust must be reduced by the halide activator in order for chromizing reactions to proceed, this phenomenon effectively reduces the activator availability and chromium potential.

The data indicates that chromized layer thickness increases linearly with increasing chromium availability. Chromium to vehicle ratios greater than about 0.7 are required to produce adequate chromized layers with mix chromium contents below about 12 percent. This was also observed as the point where surface rusting under the applied slurry was significantly reduced.

EXAMPLE II

The aqueous coating compositions shown in Table 3 were prepared as described in Example I except that, as noted in Table 3, in several cases the halide activator was added after the slurry mix was applied to the surface and dried. The coatings were applied by spread coating, flow coating or spray coating the solution onto 3-½ inch, schedule 40 Croloy 2-¼ alloy (ASTM A-335, Grade P-22) pipe.

The spread coating technique involved the manual spreading of the slurry over the pipe surface. The flow coating technique was achieved by pouring a slurry into the pipe and manually rotating the pipe to produce the desired thickness. The spray coating was achieved by using pressurized spray. Spray coatings were applied using a spray gun ("Z"gun-Model CCV made by Armour Spray Systems) specifically designed for spraying solutions having high (i.e., up to 70%) solids content. Starting with trial no. 13, the pipe was preheated to about 180° F. prior to coating. Preheating increases adhesion of the slurry and promotes drying. The coating was then bake dried by heating between 150° F. and 200° F. for at least two hours to improve slurry strength (i.e., handling capability). The ends of the pipe were sealed by welding caps thereto and then processed at the process thermal cycle conditions set forth in Table 4. Very uniform chromized layers were observed.

TABLE 3

| Trial No. | Slurry Speciman | Chromium (%) | Alumina (%) | Activator Type | Activator % | Binder (%) | Vehicle (%) | Dry Activator (grams)** |
|---|---|---|---|---|---|---|---|---|
| 11 | 1 | 10.0 | 55.0 | $NH_4Cl$ | 10.0 | 2 | 25.0 | — |
| 12 | 1 | 20.0 | 35.0 | $NH_4Cl$ | 20.0 | 2 | 25.0 | — |
| | 2 | 30.0 | 15.0 | $NH_4Cl$ | 30.0 | 2 | 25.0 | — |
| 13 | 1 | 25.0 | 25.0 | $NH_4Cl$ | — | 3 | 50.0 | 18.0 |
| | 2 | 26.7 | 26.7 | NaCl | 13.4 | 2 | 33.2 | — |
| 14 | 1 | 20.0 | 50.0 | NaCl | — | 2 | 30.0 | 9.0 |
| | 2 | 20.0 | 50.0 | $NH_4Cl$ | — | 2 | 30.0 | 9.0 |
| 15 | 1 | 12.0 | 48.0 | NaCl | — | 2 | 40.0 | 9.0 |
| | 2 | 16.0 | 36.0 | NaCl | 8.0 | 2 | 40.0 | 9.0 |
| 16 | 1 | 12.0 | 48.0 | NaCl | — | 2 | 40.0 | 9.0 |
| | 2 | 48.0 | 12.0 | NaCl | — | 2 | 40.0 | 9.0 |
| 17 | 1 | 12.0 | 48.0 | NaCl | — | 2 | 40.0 | 9.0 |
| | 2 | 48.0 | 12.0 | NaCl | — | 2 | 40.0 | 9.0 |
| 18 | 1 | 12.0 | 4 .0 | NaCl | — | 2 | 40.0 | 9.0 |
| | 2 | 12.0 | 12.0 | NaCl | — | 2 | 40.0 | 9.0 |
| 19 | 1 | 20.0 | 40.0 | NaCl | — | 2 | 40.0 | 18.0 |
| | 2 | 20.0 | 40.0 | $NH_4Br$ | — | 2 | 40.0 | 18.0 |
| 20 | 1 | 20.0 | 40.0 | $NH_4Br$ | — | 2 | 40.0 | 36.0 |
| | 2 | 20.0 | 40.0 | $NH_4Br$ | — | 2 | 40.0 | 18.0 |
| 21 | 1 | 40.0 | 20.0 | $NH_4Br$ | — | 2 | 40.0 | 18.0 |
| | 2 | 40.0 | 20.0 | $NH_4Br$ | — | 2 | 40.0 | 18.0 |

*Binder was methyl cellulose

**Dry activator addition made after slurry mix applied to sample surface and dried - lack of entry in column indicates activator was a part of initially applied slurry mix only.

TABLE 4

| Trial No. | Slurry Specimen | Application Method | Chromizing Cycle Temp (°F.) | Chromizing Cycle Time (hrs) | Applied Slurry Thickness (mils) | Calculated Chrome Potential (gm/in$^2$) |
|---|---|---|---|---|---|---|
| 11 | 1 | Spread Coat | 2000 | 2 | 250 | 0.76 |
| 12 | 1 | Spread Coat | 2000 | 2 | 250 | 1.53 |
| | 2 | Spread Coat | 2000 | 2 | 250 | 2.29 |
| 13 | 1 | Flow Coat | 2000 | 2 | 125 | 0.94 |

TABLE 4-continued

| Trial No. | Slurry Specimen | Application Method | Chromizing Cycle Temp (°F.) | Chromizing Cycle Time (hrs) | Applied Slurry Thickness (mils) | Calculated Chrome Potential (gm/in$^2$) |
|---|---|---|---|---|---|---|
| | 2 | Flow Coat | 2000 | 2 | 62 | 0.75 |
| 14 | 1 | Flow Coat | 2000 | 2 | 125 | 0.83 |
| | 2 | Flow Coat | 2000 | 2 | 125 | 0.83 |
| 15 | 1 | Spray Coat | 2000 | 2 | 62 | 0.42 |
| | 2 | Flow Coat | 2000 | 2 | 125 | 1.20 |
| 16 | 1 | Spray Coat | 2000 | 2 | 5–15 | 0.03 |
| | 2 | Spray Coat | 2000 | 2 | 5–15 | 0.14 |
| 17 | 1 | Spray Coat | 2000 | 2 | 125 | 0.39 |
| | 2 | Spray Coat | 2000 | 2 | 70–100 | 1.22 |
| 18 | 1 | Spray Coat | 2000 | 2 | 125 | 0.42 |
| | 2 | Spray Coat | 2000 | 2 | 125 | 1.79 |
| 19 | 1 | Spray Coat | 2200 | 2 | 125 | 0.70 |
| | 2 | Spray Coat | 2200 | 2 | 125 | 0.70 |
| 20 | 1 | Spray Coat | 2200 | 2 | 125 | 0.70 |
| | 2 | Spray Coat | 2200 | 2 | 250 | 1.40 |
| 21 | 1 | Spray Coat | 2200 | 2 | 62 | 0.75 |
| | 2 | Spray Coat | 2200 | 2 | 125 | 1.50 |

The components coated by the spread coating (trials 11 and 12) and spray coating (trails 16 through 21) techniques were found to have chromized layers comparable to those of the standard pack cementation process. The specimens prepared with the flow coating technique (trials 13, 14 and 15) had comparably thinner but metallographically identical chromized layers.

EXAMPLE III

The multiple layer single component compositions shown in Table 5 were prepared as described earlier, except that the sole solid component in the undercoat was alumina, while the sole solid component in the top coat was chromium. The coatings were applied by spray coating the solution inside of 3-½ inch, schedule 40 Croloy 2-¼ alloy (ASTM A-335, Grade P-22) pipe.

The spray coating was achieved by using pressurized spray. Spray coatings were again applied using a spray gun ("Z" gun-Model CCV made by Armour Spray Systems) specifically designed for spraying solutions having high solids content. The pipe was preheated to about 180° F. prior to coating. The undercoat was air dried before application of the top coat. Both layers were then bake dried by heating between 150° F. and 200° F. for at least two hours. The ends of the pipe were sealed by welding caps thereto and then processed at the process thermal cycle conditions set forth in Table 6.

TABLE 5

| Trial No. | Slurry Specimen | | Chromium (%) | Alumina (%) | Activator Type | Vehicle Wt. (%) | Binder (%)* | Water (%) | Dry Activator (Grams) |
|---|---|---|---|---|---|---|---|---|---|
| 22 | 1 | (undercoat) | 0 | 60 | $NH_4Br$ | 40 | 2 B | 38 | 18 |
| | 2 | (top coat) | 60 | 0 | $NH_4Br$ | 40 | 2 B | 38 | 18 |
| 23 | 1 | (undercoat) | 0 | 60 | $NH_4Br$ | 40 | 2 B | 38 | 18 |
| | 2 | (top coat) | 60 | 0 | NaCl | 40 | 2 B | 38 | 18 |
| 24 | 1 | (undercoat) | 0 | 60 | $NH_4Br$ | 40 | 2 B | 38 | 100 |
| | 2 | (top coat) | 60 | 0 | $NH_4Br$ | 40 | 2 B | 38 | 100 |

*B: methyl cellulose

TABLE 6

| Trial No. | Slurry Specimen | Application Method | Chromizing Cycle Temp (°F.) | Chromizing Cycle Time (hrs) | Applied(1) Slurry Thickness (mils) top coat | | under coat | | total | Calculated Chrome Potential (gm/in$^2$) |
|---|---|---|---|---|---|---|---|---|---|---|
| 22 | 1 | Spray Coat | 2200 | 2 | 12 | + | (12) | = | 24 | 0.24 |
| | 2 | Spray Coat | 2200 | 2 | 60 | + | (12) | = | 72 | 1.22 |
| 23 | 1 | Spray Coat | 2200 | 2 | 30 | + | (25) | = | 55 | 0.61 |
| | 2 | Spray Coat | 2200 | 2 | 30 | + | (15) | = | 45 | 0.61 |
| 24 | 1 | Spray Coat | 2200 | 2 | 15 | + | (10) | = | 25 | 0.30 |

Note: (1)Number in parenthesis is thickness of $Al_2O_3$ undercoat

Very uniform chromized layers were observed. Results indicated that relatively thick (5 to 9 mils) chromized layers could be produced by the application of the multiple layer single component slurries. Although chromium layer thickness appeared to increase in relation to applied slurry thicknesses, it was found that slurry thickness values of at least 10 mils would produce desired results. Also it appeared that an ammonium bromide activator produced better results than sodium chloride. In general, when using this multiple layer technique, best results were obtained when using thin undercoat and slurry layers. These thin layers remained attached to the surface during the chromizing cycle and could be removed relatively easily afterwards.

Although Table 5 indicates that only methyl cellulose was utilized as the binder, it is anticipated that ammonium alginate would also work. Similarly, although only halide activators of sodium chloride (NaCl) and ammonium bromide ($NH_4Br$) were utilized, it is anticipated that ammonium chloride ($NH_4Cl$) would also work.

Further trials have indicated that the above methods can be scaled up to accommodate larger components; e.g., such as pipes of 24 inches outside diameter, 1-⅛ inch wall thickness, and exceeding 15 feet in length. Alternative slurry layers (i.e., single layer, 30% chromium—applied slurry thickness of 0.125 inches; and double layer, with outer layer of 60% chromium—applied slurry thickness of 0.015 inches) can be used to produce the desired product. This results from the fact that different slurry layers can be formulated which provide essentially the same "chromizing potential" in terms of chromium per square inch of product surface to be chromized. In general, the trial results described above indicate that at least 0.2 grams/in$^2$ of chromium are required to produce acceptable chromium layers of the type being sought (i.e., approximately 2 mils for tubing and 6 mils for pipe). Of course, commercial-scale production operations may require a higher chromium potential value, such as 0.75 to 1.5 grams/in$^2$ of chromium to minimize the risk of unacceptable chromized layers. Applied slurry thicknesses ranging from approximately 4 to 250 mils, applied by spray coating, appear to be an efficient approach, with dry activator levels ranging from approximately 0.2 to 1.4 grams/in$^2$ of product surface.

While specific embodiments of the present invention have been shown and described in detail to illustrate the application of the principles of the invention, certain modifications and improvements will occur to those skilled in the art upon reading the foregoing description. Similarly, it should be understood that all such modifications and improvements have been deleted herein for the sake of conciseness and readability but are properly within the scope of the following claims.

The invention claimed is:

1. A method of chromizing a surface of a ferritic boiler component, comprising the steps of:

applying an aqueous coating composition to the surface, the aqueous coating composition containing at least about 10% by weight of chromium, at least about 12% by weight alumina, and a binder selected from the group consisting of ammonium alginate and methyl cellulose, said chromium being present in a weight ratio of chromium to the sum of water and binder of greater than about 0.7;

drying the applied aqueous coating composition on the surface; and applying a halide activator onto the coated surface, said halide activator being a member selected from the group consisting of ammonium chloride, sodium chloride and ammonium bromide.

2. The method of chromizing the surface of a ferritic boiler component, as set forth in claim 1, further comprising the step of preheating the component prior to applying the aqueous coating composition onto the surface and applying the aqueous coating composition to the preheated component.

3. A method of chromizing a surface of a ferritic boiler component, comprising the steps of:

(a) coating the surface with an aqueous coating composition, the aqueous coating composition containing at least about 10% by weight of chromium, at least about 12% by weight alumina, and a binder selected from the group consisting of ammonium alginate and methyl cellulose, said chromium being present in a weight ratio of chromium to the sum of water and binder of greater than about 0.7;

(b) drying the coating on the surface;

(c) applying a halide activator onto the surface, said halide activator being a member selected from the group consisting of ammonium chloride, sodium chloride, and ammonium bromide;

(d) placing the ferritic boiler component in a controlled atmosphere retort; and (e) heating the coated ferritic boiler component to a temperature and holding at that temperature for a time sufficient to produce a chromium rich diffusion layer on the surface.

4. A method of chromizing a surface of a ferritic boiler component, the surface being an interior surface of a ferritic tubing, comprising the steps of:

(a) coating the interior surface with an aqueous coating composition, the aqueous coating composition containing at least about 10% by weight of chromium, at least about 12% by weight alumina, and a binder selected from the group consisting of ammonium alginate and methyl cellulose, said chromium being present in weight ratio of chromium to the sum of water and binder of greater than about 0.7;

(b) drying the coating on the interior surface;

(c) applying a halide activator onto the surface, said halide activator being a member selected from the group consisting of ammonium chloride, sodium chloride, and ammonium bromide;

(d) sealing the ends of the ferritic tubing component by placing end caps thereon to produce a self-contained retort; and (e) heating the coated ferritic tubing component to a temperature and holding at that temperature for a time sufficient to produce a chromium rich diffusion layer on the interior surface.

5. A method of chromizing a surface of a ferritic boiler component through the application of multiple layer slurry coatings comprising the steps of:

(a) applying an undercoat layer of an aqueous coating composition including alumina and a binder selected from the group consisting of ammonium alginate and methyl cellulose to the surface and drying said undercoat layer;

(b) applying a top coat layer of an aqueous coating composition including chromium and a binder selected from the group consisting of ammonium alginate and methyl cellulose over the undercoat layer and drying said top coat layer;

(c) applying a halide activator selected from the group consisting of ammonium chloride, sodium chloride, and ammonium bromide onto said top coat layer;

(d) placing the ferritic boiler component in a controlled atmosphere retort; and (e) heating the coated ferritic boiler component to a temperature and holding at that temperature for a time sufficient to produce a chromium rich diffusion layer on the surface.

6. The method of chromizing the surface of a ferritic boiler component, as set forth in claim 5, wherein the undercoat layer is comprised of 60% alumina, 2% binder, and 38% water, all percentages being on a per weight basis of the as-applied total slurry undercoat layer prior to application and drying.

7. The method of chromizing the surface of a ferritic boiler component, as set forth in claim 5, wherein the top coat layer is comprised of 60% chromium, 2% binder, and 38% water, all percentages being on a per weight basis of the as-applied total slurry top coat layer prior to application and drying.

8. The method of chromizing the surface of a ferritic boiler component, as set forth in claim 5, wherein both the undercoat layer and the top coat layer are applied to the surface in a thickness of at least 0.010 inches.

9. The method, as set forth in claim 5, further comprising the steps of preheating the component to a temperature of about 180° F. prior to applying the undercoat and top coat layers and applying said layers to the preheated component, and bake drying the coated component at a temperature of about 150° F. to 200° F.

10. The method of chromizing the surface of a ferritic boiler component, as set forth in claim 5, wherein the step of applying the multiple layer aqueous coating compositions to the surface comprises spray coating.

11. In a method of chromizing a surface of a ferritic boiler component, the steps which comprise: applying an aqueous coating composition to the surface containing sufficient chromium to produce an as-applied chromium potential in the range of 0.2 grams/in$^2$ to 1.5 grams/in$^2$ of surface and applying a dry activator in an amount sufficient to produce an as-applied dry activator level in the range of 0.2 grams/in$^2$ to 1.4 grams/in$^2$ of surface.

* * * * *